US009109542B2

(12) United States Patent
Sugishita et al.

(10) Patent No.: US 9,109,542 B2
(45) Date of Patent: Aug. 18, 2015

(54) CARBURETOR

(75) Inventors: Yuu Sugishita, Saitama (JP); Takashi Ohniwa, Tokyo (JP)

(73) Assignee: HUSQVARNA ZENOAH CO., LTD., Saitama (JP)

( * ) Notice: Subject to any disclaimer, the term of this patent is extended or adjusted under 35 U.S.C. 154(b) by 488 days.

(21) Appl. No.: 13/391,329

(22) PCT Filed: Aug. 20, 2009

(86) PCT No.: PCT/JP2009/064577

§ 371 (c)(1),
(2), (4) Date: Feb. 20, 2012

(87) PCT Pub. No.: WO2011/021293

PCT Pub. Date: Feb. 24, 2011

(65) Prior Publication Data

US 2012/0146249 A1 Jun. 14, 2012

(51) Int. Cl.

| | |
|---|---|
| ***B01F 3/04*** | (2006.01) |
| ***F02M 1/02*** | (2006.01) |
| ***F02B 25/22*** | (2006.01) |
| ***F02M 19/08*** | (2006.01) |
| ***F02D 9/10*** | (2006.01) |
| *F02B 63/02* | (2006.01) |
| *F02B 75/02* | (2006.01) |

(52) U.S. Cl.

CPC ..... *F02M 1/02* (2013.01); *F02B 25/22* (2013.01); *F02D 9/1045* (2013.01); *F02M 19/08* (2013.01); *F02M 19/081* (2013.01); *F02B 63/02* (2013.01); *F02B 2075/025* (2013.01)

(58) Field of Classification Search

CPC ..... F02M 22/00; F02M 7/12; F02M 2700/13; F02M 17/04; F02M 1/02; F02M 1/10; F02B 25/22

See application file for complete search history.

(56) References Cited

U.S. PATENT DOCUMENTS 4,073,278 A * 2/1978 Glenn ..... 123/198 F
4,106,471 A * 8/1978 Nakajima et al. ..... 123/198 F (Continued)

FOREIGN PATENT DOCUMENTS

| | | |
|---|---|---|
| JP | 2001-295652 | 10/2001 |
| JP | 2003-193911 | 7/2003 |
| JP | 2008-019859 | 1/2008 |

OTHER PUBLICATIONS

International Search Report and Written Opinion of PCT/JP2009/064577 mailed Sep. 15, 2009.

(Continued)

*Primary Examiner* — Amber Orlando
(74) *Attorney, Agent, or Firm* — Nelson Mullins Riley & Scarborough LLP

(57) ABSTRACT

In a carburetor (1) including a choke valve (7) on the upstream side inside an aspiration passage (3) and a throttle valve (8) on the downstream side, the valves (7) and (8) are disposed at positions such that the valves adjacently oppose each other when having been turned to be in the fully open state, a bulging part (11) that bulges toward the region (A1) between the adjacently opposing valves (7) and (8) is integrally provided inside a venturi (9), and the aspiration passage (3) is divided into an air-fuel mixture passage (4) located on the side where a main jet (10) is provided and an air passage (5) through which leading air circulates by the bulging part and the valves (7) and (8), both of which are in the fully open condition.

7 Claims, 13 Drawing Sheets

(56) References Cited

U.S. PATENT DOCUMENTS

| | | | | |
|---|---|---|---|---|
| 4,335,061 | A * | 6/1982 | Kobayashi | 261/44.8 |
| 6,000,369 | A * | 12/1999 | Koizumi | 123/179.16 |
| 7,100,551 | B2 * | 9/2006 | Rosskamp | 123/73 PP |
| 2008/0035124 | A1 * | 2/2008 | Dopke et al. | 123/543 |
| 2008/0296790 | A1 * | 12/2008 | Dopke et al. | 261/127 |
| 2009/0013963 | A1 * | 1/2009 | Eberhardt et al. | 123/337 |
| 2009/0320792 | A1 * | 12/2009 | Kashima | 123/347 |

OTHER PUBLICATIONS

Chapter I International Preliminary Report on Patentability of PCT/JP2009/064577 mailed Mar. 13, 2012.

* cited by examiner

CARBURETOR

FIELD OF THE INVENTION

The present invention relates to carburetors and more particularly relates to carburetors for stratified scavenging two-stroke engines.

PRIOR ART

Traditionally, as a carburetor used for a stratified scavenging two-stroke engine, one is known which is constructed with an air intake channel partitioned into an air-fuel mixture channel and an air channel for guiding air by a divider plate or partition wall (Patent Literature 1 and 2). Such a carburetor is advantageous in that it allows size reduction of the entire air intake system since it is not required to provide an air-fuel mixture channel and an air channel as independent and separate channels from the beginning.

The carburetor according to the Patent Literature 1 provides a divider plate inside the air intake channel, constructed with a throttle plate of a butterfly valve in its fully opened state which is continuous to the downstream side of said divider plate as well as a divider plate provided in an insulator which is continuous to the throttle plate on the downstream side of the throttle plate. That is, the air intake channel is partitioned into an air-fuel mixture channel and an air channel along the carburetor and the insulator by the divider plate and the throttle plate inside the carburetor as well as the divider plate inside the insulator.

In contrast, in the carburetor according to the Patent Literature 2, an air intake channel is divided into an air-fuel mixture channel and an air channel from an air cleaner to a carburetor and an insulator by a partition wall inside the air cleaner, a partition wall in the carburetor, and a partition wall in the insulator. Further, a choke plate and a throttle plate, each consisting of a butterfly valve, are rotatably incorporated into the partition wall inside the carburetor. Even with this construction, the air intake channel is partitioned into the air-fuel mixture channel and the air channel by each of the partition walls and the throttle plate.

On the other hand, it has been suggested to provide a section known as a flow guide element on one side of the throttle plate without providing divider plates or partition walls (Patent Literature 3).

According to the Patent Literature 3, although the air intake channel is substantially narrowed between a venturi and said flow guide element when the throttle valve is fully opened, this can make it difficult for fuel to enter the air channel side since the fuel from the main jet provided at this narrowed section is efficiently injected to the side where the flow guide element is provided, i.e., the air-fuel mixture channel side.

PRIOR ART LITERATURE

Patent Literature

Patent Literature 1: Japanese Unexamined Patent Application Publication (Translation of PCT Application) No. 2008-522074

Patent Literature 2: WO 08/033062

Patent Literature 3: Japanese Unexamined Patent Application Publication No. 2006-283758

SUMMARY

Problem to be Solved by the Invention

However, there is a problem especially in the case of the Patent Literature 2 which comprises valves for the throttle and choke, in that the carburetor becomes longer in the direction of air intake flow, failing to fully facilitate size reduction of carburetors because some space is required to allocate the partition wall that exists across the air intake channel between the valves as well.

There is also a problem in the case of the Patent Literature 3, in that the configuration becomes more complex because, due to an opening formed between the throttle plate and the divider plate (partition wall) inside the insulator, it is required to enhance the geometry of the flow guide element so that the fuel does not to get into the air channel from the air-fuel mixture channel through this opening.

The objective of the present invention is to provide carburetors for stratified scavenging two-stroke engines, which can reduce the size of an air intake system without fail even when comprising valves for the throttle and choke and can divide an air intake channel into an air-fuel mixture channel and an air channel in a simple configuration without substantially changing the traditional configuration.

Means for Solving the Problem

The carburetor according to the present invention comprises a choke valve on the upstream side and a throttle valve on the downstream side inside an air intake channel, wherein said valves are rotated in their fully opened state to closely oppose each other, a bulging portion is provided which bulges toward a region between said closely opposed valves on the inner periphery of said air intake channel, and said intake channel is divided into an air-fuel mixture channel at which a fuel intake port is provided and an air channel through which guiding air flows by said valves in said fully opened state and said bulging portion.

According to the present invention, said bulging portion may be a venturi provided inside said air intake channel or may be formed to be a plate shape separated from a venturi.

The carburetor according to the present invention comprises a choke valve on the upstream side and a throttle valve on the downstream side inside an air intake channel, wherein a gap between said closely opposed valves in their fully opened state is nearly uniformly formed widthwise of said air intake channel, and said air intake channel is divided into an air-fuel mixture channel at which a fuel intake port is provided and an air channel through which guiding air flows by said valves in said fully opened state.

Effect of the Invention

According to the present invention in which a bulging portion is provided on the inner periphery of an air intake channel, since such a bulging portion may be bulged to cover the region formed by the valves to closely oppose each other, the valves can be arranged closely up to the position at which they are almost in contact in their fully opened state so that the carburetor can be shortened in the direction of air intake flow to facilitate size reduction. Accordingly, the traditional configuration corresponding to a flow guide element is not required and the air intake channel can be divided into an air-fuel mixture channel and an air channel in a simple configuration.

In this case, when the bulging portion is formed by a venturi, the carburetor can be constructed in the same way that a normal air intake channel having a venturi is provided, avoiding a complex construction process. It should be noted that since the valves are never closely located up to near contact and a venturi is not bulged enough to block the region between the valves in a traditional carburetor, in this regard, a carburetor comprising a traditional venturi is not included in the carburetors according to the present invention.

Additionally, when the bulging portion is formed in a plate-shape separated from a venturi, the venturi can be ensured of having bigger diameter, resulting in the advantage of being able to produce less air intake resistance.

On the other hand, according to the present invention in which the gap width between the closely opposing valves is uniform, since the air intake channel can be divided into the air-fuel mixture channel and the air channel by the valves without using any traditional partition walls, the valves can be also arranged closely up to the position at which they are almost in contact so that size reduction of the carburetors can be achieved. Further, since it is not required to provide a traditional flow guide element, construction can be also simplified.

EMBODIMENTS OF THE INVENTION

Each embodiment of the present invention is described below with reference to the drawings. It should be noted that in the second and later embodiments described below, the same symbols will be used for the same parts and functions as the first embodiment described next and so the description for those parts will be omitted or simplified.

First Embodiment

Figure 1:
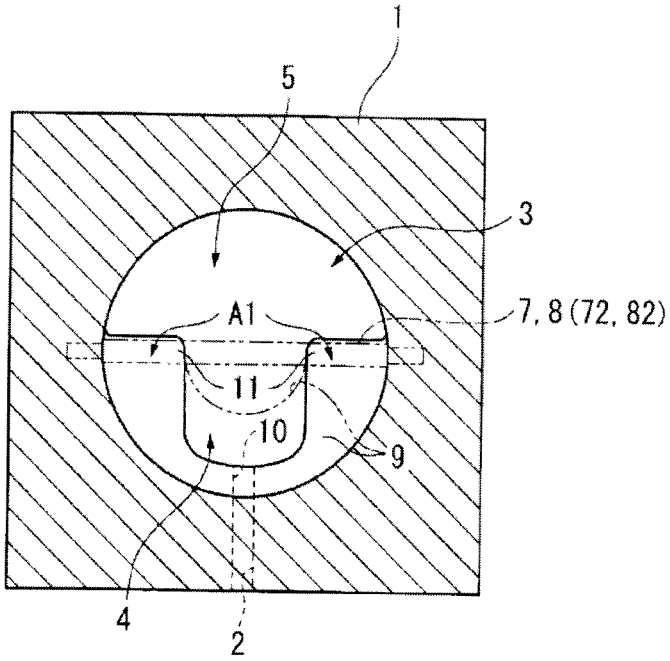
FIG. 1 is a cross-sectional view of the carburetor according to the first embodiment of the present invention, looking from the incoming side of air intake.
Figure 2:
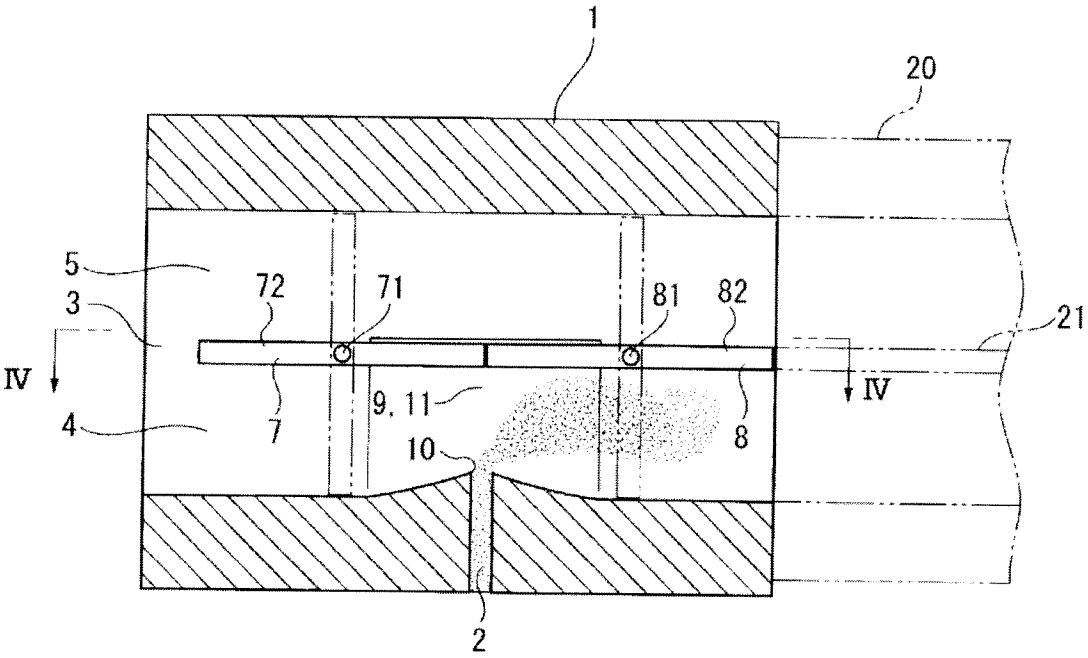
FIG. 2 is a cross-sectional view illustrating the carburetor according to the first embodiment.
Figure 3:
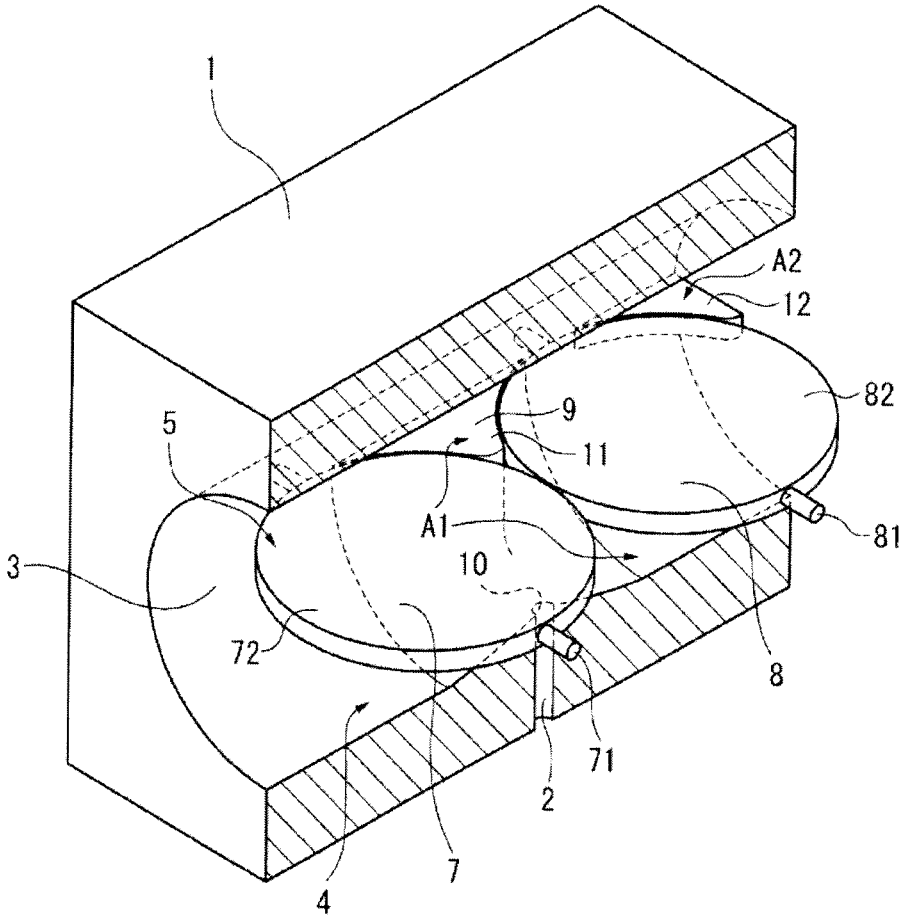
FIG. 3 is a cross-sectional perspective view illustrating the carburetor according to the first embodiment.

In FIGS. 1-2, a carburetor 1 according to this embodiment is used for a stratified scavenging two-stroke engine and is configured to include a choke valve 7 on the upstream side of the air intake flow direction and a throttle valve 8 on the downstream side thereof in an air intake channel 3 provided in the body. On the upstream side of the carburetor 1 itself, an air filter (not shown) is provided and the downstream side of the carburetor 1 is attached to the engine via a plastic insulator 20 with heat resistance. The body of the carburetor 1 and the valves 7 and 8 are made from metal.

Inside the air intake channel 3 of the carburetor 1 as such, a near U-shaped venturi 9 is provided which bulges from the inner periphery of said air intake channel 3. The venturi 9 is provided at the section accommodating the lower half of the inner periphery of the air intake channel 3 in the figure, and does not exist in the section accommodating the upper half. The geometry of the opening of the venturi 9 is a near rectangular shape with an upward opening and is thin-walled in the lower section of the venturi 9. It should be noted that the shape of the opening of the venturi 9 is not limited to being rectangular and may be formed as a long hole or a half circle as shown in the two-dot chain line in FIG. 1.

The venturi 9 is positioned at the middle point between the choke valve 7 on the upstream side and the throttle valve 8 on the downstream side. In a part of the opening of the venturi 9 (the lower section in the figure), a main jet 10 is provided as a fuel intake port through which fuel withdrawn from a fuel line 2 is injected via the pressure pulsation from the engine. At both ends of the venturi 9, a bulging portion 11 that bulges inward from the air intake channel 3 is provided. The bulging portion 11 is provided on both the left and right sides and forms the opening of the venturi 9 with vertical inner portions.

The valves 7 and 8 are each configured as a butterfly valve with rotating shafts 71 and 81 and disk-shaped rotating plates 72 and 82. The rotating shafts 71 and 81 of the valves 7 and 8 are set to be parallel and therefore, when the choke is effective and the engine is idling, the valves 7 and 8 are in the closed position and, as shown by the two-dot chain line in FIG. 2 and in FIG. 4 (A), the rotating plates 72 and 82 face each other across the venturi 9 with their disk-shaped faces opposed. Additionally, in this state, fuel for idling is injected from a sub jet (not shown) provided on the downstream side of the rotating plate 82.

In contrast, when the throttle valve 8 is fully opened such as when driving the engine at high revolutions, the choke valve 7 is naturally in its fully opened position at which the rotating plates 72 and 82 of the valves 7 and 8 are aligned on the same plane, making it flat from the upstream side to the downstream side (see FIG. 1-3 and FIG. 4(B)).

At this time, for the valves 7 and 8 in their fully opened state, the edges of the rotating plates 72 and 82 are closely opposed such that they are almost in contact, and in the middle of the air intake channel 3, the rotating plates 72 and 82 are aligned along the air intake flow direction without a near-gap. In other words, the air intake channel is divided into two sections, upper and lower in the figure, by the valves 7 and 8.

One of the divided sections in the air intake channel 3 is the side at which the main jet is provided to become the air-fuel mixture channel 4. The other section in the air intake channel 3 becomes the air channel 5 through which guiding air flows. In other words, according to this embodiment, of the channels 4 and 5, the venturi 9 described above is provided to accommodate the air-fuel mixture channel 4. Further, according to this embodiment in which the valves 7 and 8 are closely opposed in their fully opened state, region A1, which is nearly triangular in a planar view, is defined on the left and right sides between the rotating plates 72 and 82, and these regions A are covered and blocked by the bulging portion 11 at both ends of the venturi 9.

In this case, although the venturi 9 has the bulging portion 11 to bulge enough to block region A1, the substantially bulging venturi 9 (the bulging portion 11) never prevents rotation of the valves 7 and 8 because the geometry of the edges of the venturi 9 is formed as nearly triangular to accommodate region A.

Further, for the bulging portion 11 whose edge geometry is nearly triangular, the apex is rounded and the oblique sides sandwiching this apex are curved to accommodate the external periphery of the rotating plates 72 and 82. Although there is a slight gap between the rounded apex and the rotating plates 72 and 82, fuel never gets into the air channel 5 from the air-fuel mixture channel 4 through such a gap because the fuel from the main jet 10 is injected toward the downstream side.

Inside the air intake channel 3, a pair of plate-shaped bulging portions 12 are also provided to cover the region A2 formed between the throttle valve 8 fully opened and the insulator 20. The geometry of this bulging portion 12 in a planar view corresponds to the shape created by dividing the bulging portion 11 of a planar view into two. On the downstream side of the bulging portion 12 and the rotating plate 82, a divider plate 21 provided in the insulator 20 is opposed.

In this embodiment as such, the air-fuel mixture channel 4 and the air channel 5 can be divided more securely and the exhaust gas emissions can be enhanced by preventing fuel from getting into the air channel 5 side because regions A1 and A2 are blocked by the bulging portions 11 and 12 when the valves 7 and 8 are in their fully opened state.

Moreover, since the valves 7 and 8 are arranged closer to the level in which they are contacting in their fully opened state, the length of the carburetor 1 can be shortened in the direction of air intake flow and size reduction of the entire intake system can be facilitated more. Additionally, since a traditional flow guide element is not required in the rotating plate 82 of the throttle valve 8, the throttle valve 8 in the traditional simple configuration can be used and a divider plate or partition wall is not required to be constructed separately from the venturi 9, allowing the object of the present invention to be achieved without increasing the number of parts.

Figure 4A:
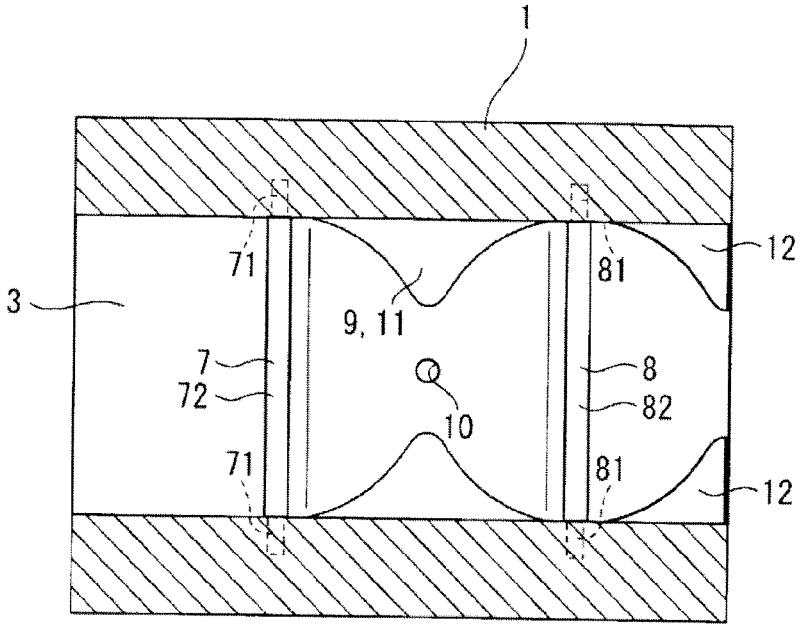
FIG. 4A is a cross-sectional view along the IV-IV line in FIG. 2, illustrating the fully closed state.
Figure 4B:
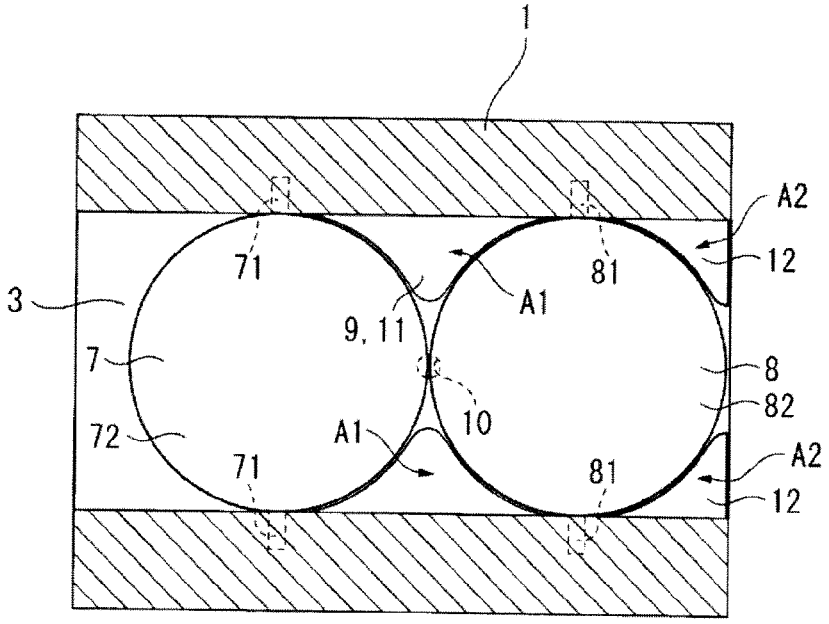
FIG. 4B is a cross-sectional view along the IV-IV line in FIG. 2, illustrating the fully opened state.

Moreover, the bulging portion 12 shown in the FIG. 4 can be provided by incorporating into the divider plate 21 of the insulator 20 to guide from the insulator 20 side to the carburetor 1 side, whereby obtaining an effect in which the carburetor 1 can be constructed in a way such that the regular air intake channel 3 with the venturi 9 is provided.

Second Embodiment

Figure 5:
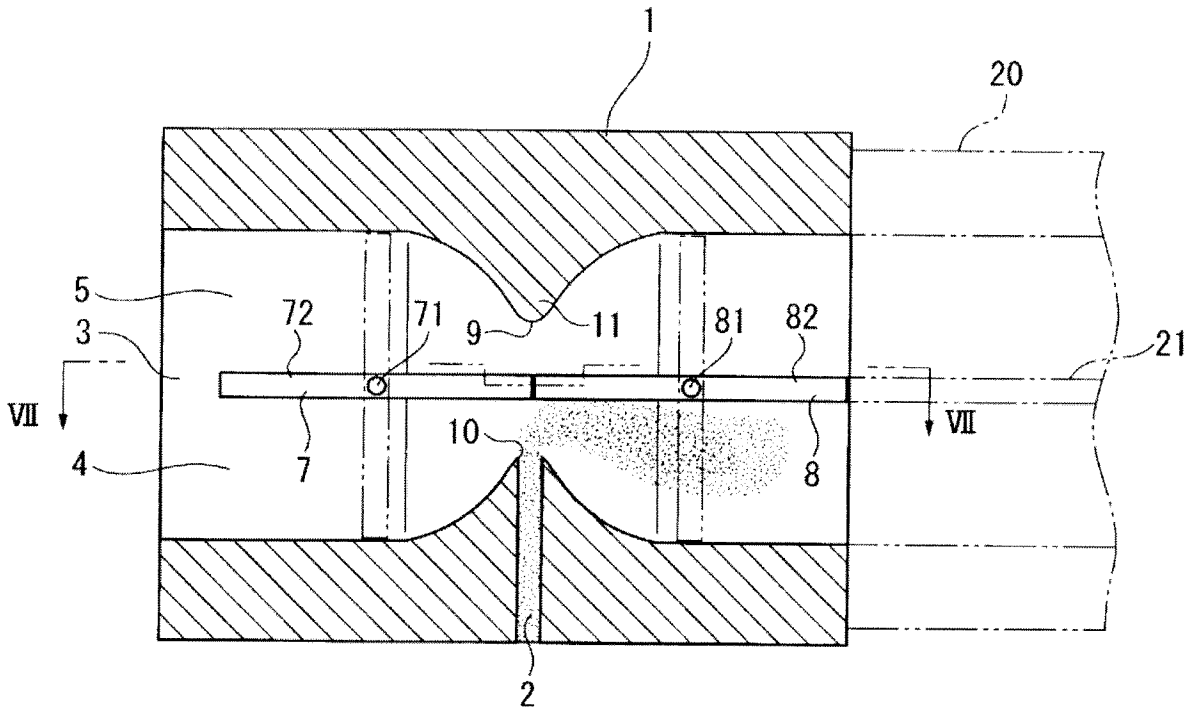
FIG. 5 is a cross-sectional view illustrating the carburetor according to the second embodiment of the present invention.
Figure 6:
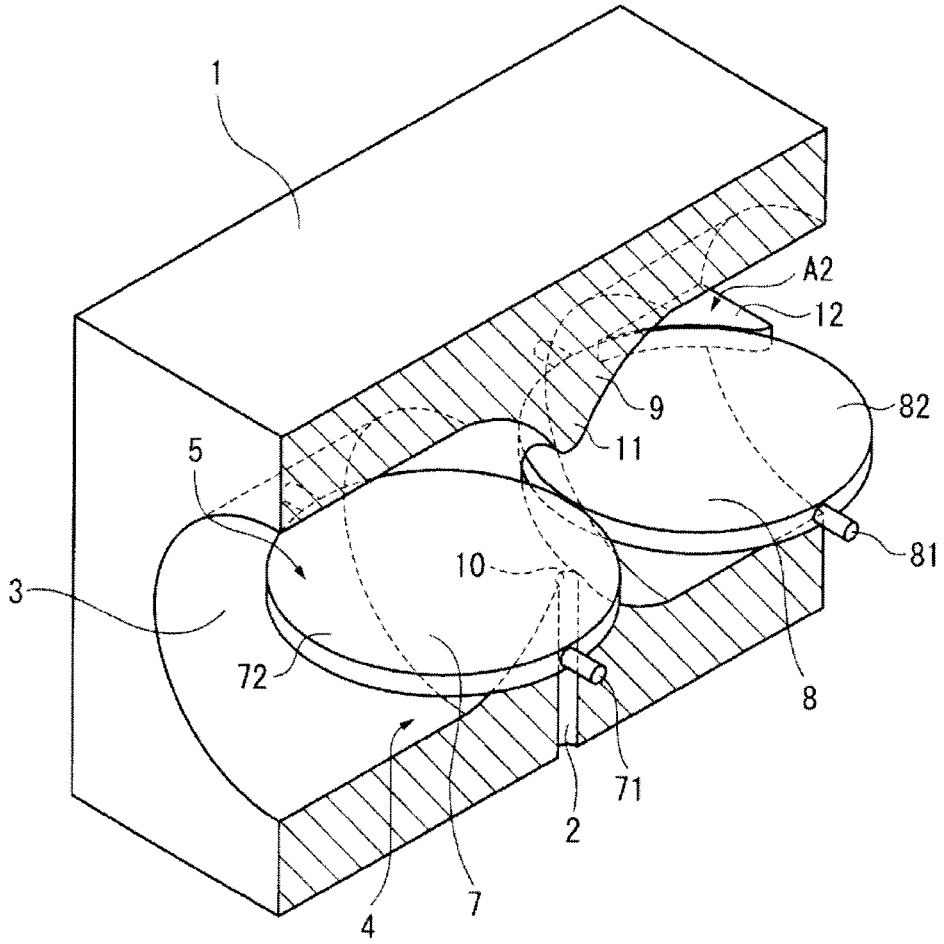
FIG. 6 is a cross-sectional perspective view illustrating the carburetor according to the second embodiment.
Figure 7A:
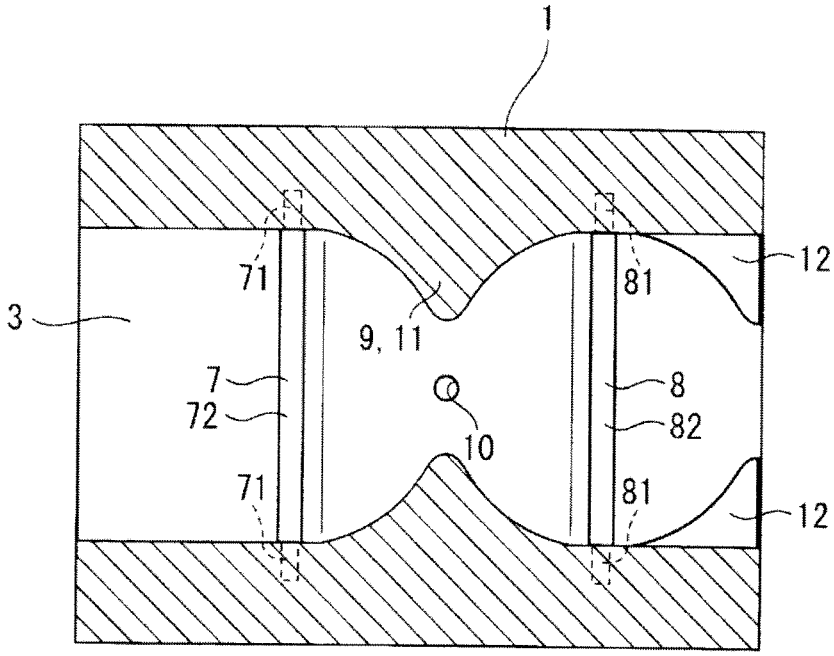
FIG. 7A is a cross-sectional view along the line of VII-VII in FIG. 5, illustrating the fully closed state.
Figure 7B:
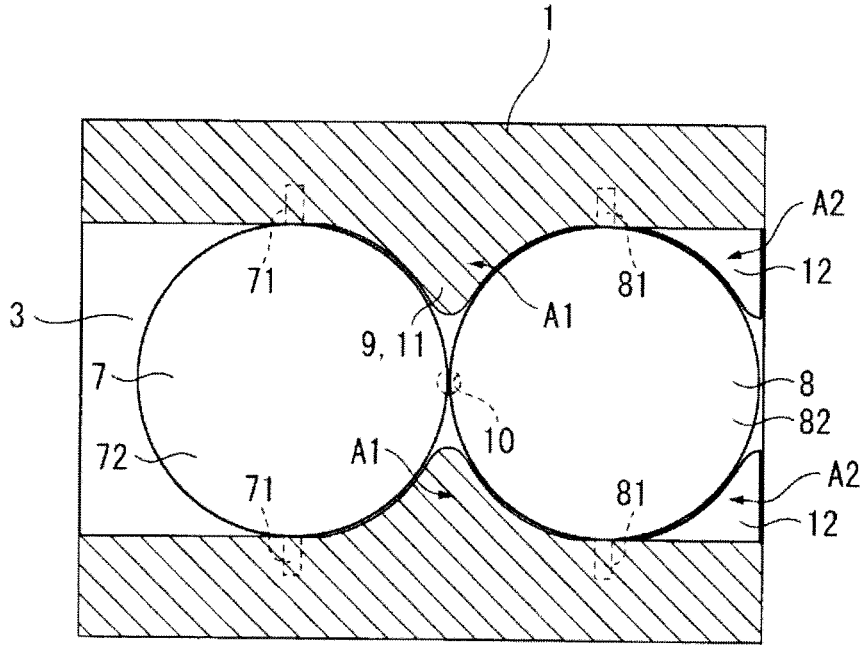
FIG. 7B is a cross-sectional view along the line of VII-VII in FIG. 5, illustrating the fully opened state.

FIGS. 5-7 show the carburetor 1 according to the second embodiment of the present invention. According to this embodiment, the venturi 9 is formed as a continuous circle in the circumferential direction inside the air intake channel 3 and therefore, the bulging portion 11 formed to be incorporated on the inner diameter side of the venturi 9 is circular, having equal cross-sectional geometry over the entire region in the circumferential direction. As shown in FIGS. 7 (A) and (B), the cross-sectional geometry corresponding to region A of the bulging portion 11 is nearly triangular with a rounded apex, which is nearly the same as the geometry of the edge of the bulging portion 11 according to the first embodiment.

The opening of the venturi 9 is a circle. In other words, inside the air intake channel 3 having same diameter dimensions as traditional ones, the venturi 9 with a smaller venturi diameter than traditional ones is provided. It should be noted that the opening of the venturi 9 is not limited to a circle and may be a long hole with longer vertical dimensions or rectangular. In other words, it is a shape created by providing the venturi 9 according to the first embodiment along both the top and bottom.

According to this embodiment above, almost same the effect as the first embodiment can be obtained, such as the gap between the valves 7 and 8 being well-blocked by the bulging portion 11 of the venturi 9.

Third Embodiment

Figure 8:
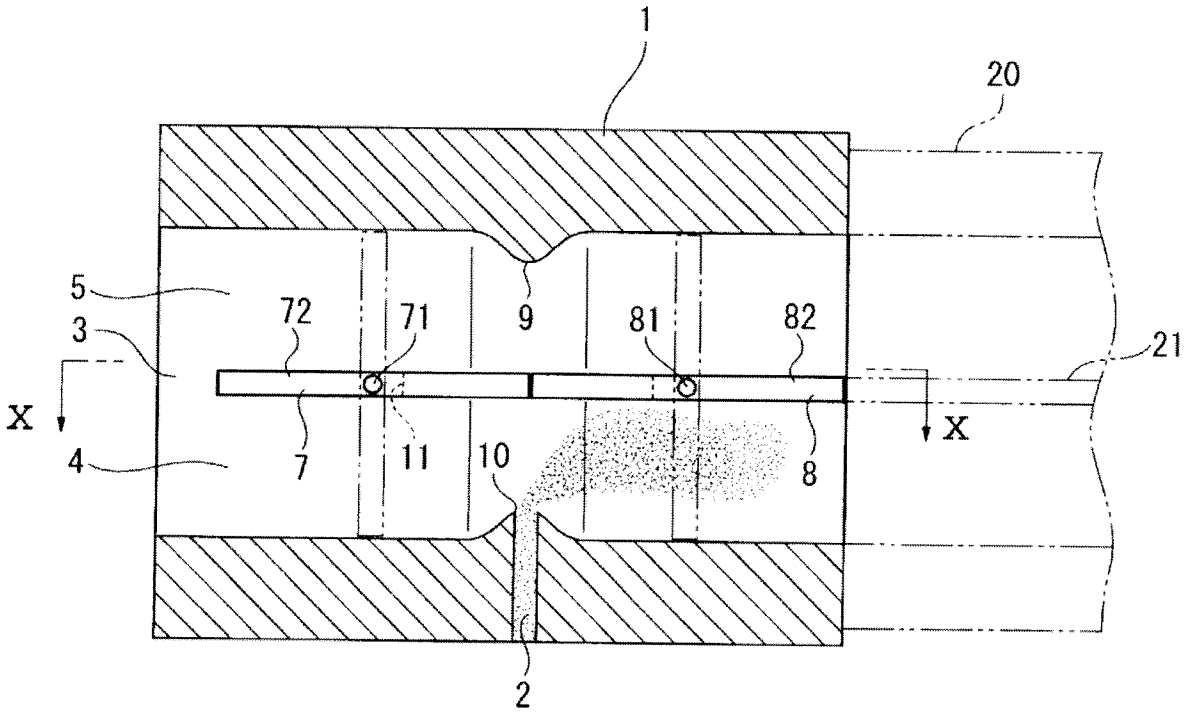
FIG. 8 is a cross-sectional view illustrating the carburetor according to the third embodiment of the present invention.
Figure 10A:
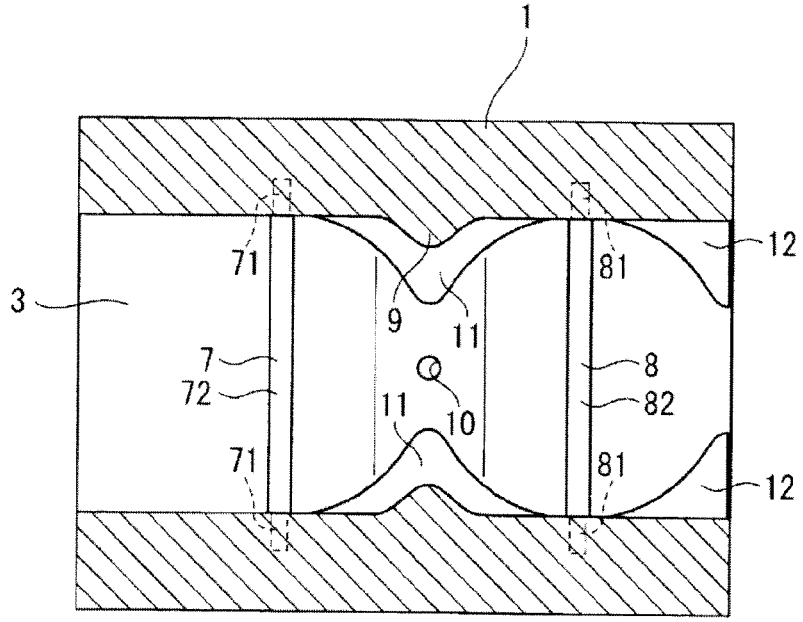
FIG. 10A is a cross-sectional view along the X-X line in FIG. 8, illustrating the fully closed state.
Figure 10B:
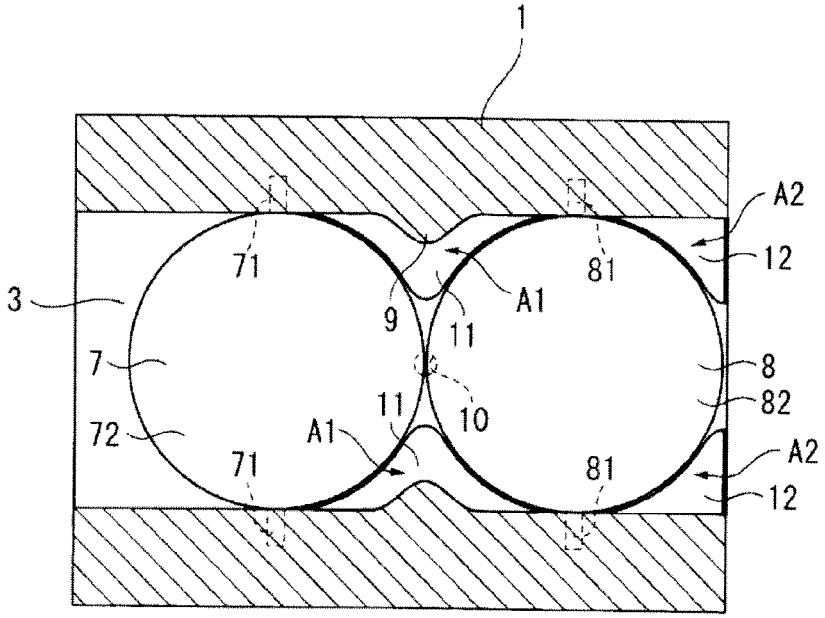
FIG. 10B is a cross-sectional view along the X-X line in FIG. 8, illustrating the fully opened state.

FIGS. 8-7 show the carburetor 1 according to the third embodiment of the present invention. According to this embodiment, the bulging portion 11 with a geometry bigger than the cross-sectional geometry of the traditional venturi 9 is provided, and in this regard, it is different from the second embodiment described above. The bulging portion 11 is plate-shaped, with a pair provided at the position accommodating the venturi 9, opposed in the radial direction. The thickness of the bulging portion 11 is nearly the same level as the thickness of the rotating plates 72 and 82 of the valves 7 and 8. As shown in FIGS. 10 (A) and (B), the geometry of the bulging portion in a planar view is the same as the shape created by joining two of the bulging portions 12, which is nearly triangular to accommodate region A1.

However, the bulging portion 11 as such, similar to the venturi 9, may be provided by incorporating into the body of the carburetor 1 using the same material, or may be constructed separately using plastic, etc. to be assembled into the venturi 9.

Again, in this embodiment described above, not only can region A1 between the valves 7 and 8 be blocked by the bulging portion 11 but also the valves 7 and 8 can be substantially closely arranged and same traditional ones can be used for the valves 7 and 8.

Also, the opening area of the venturi 9 is not reduced more than required, allowing less air resistance because the bulging portions 11 and 12 are plate-shaped.

Fourth Embodiment

Figure 11:
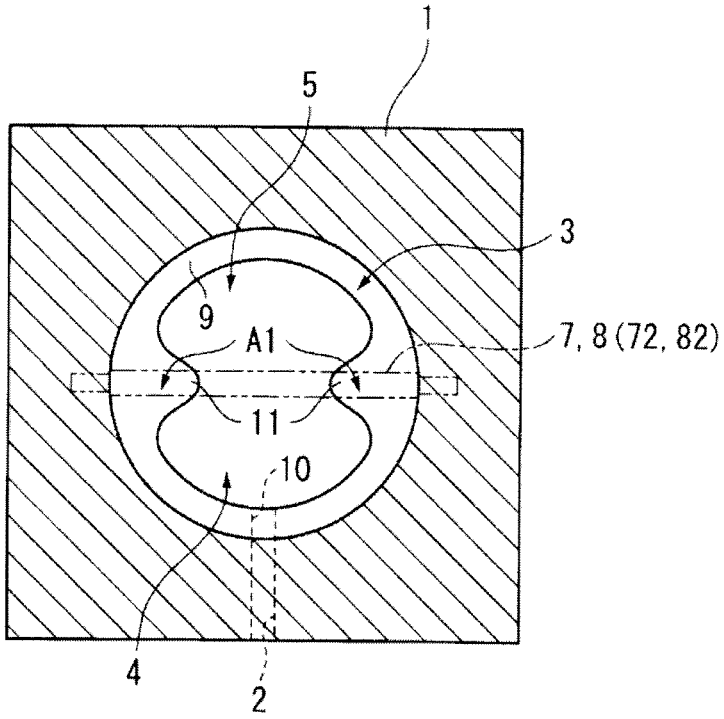
FIG. 11 is a cross-sectional view of the carburetor according to the fourth embodiment of the present invention, facing the side into which intake air flows.
Figure 12:
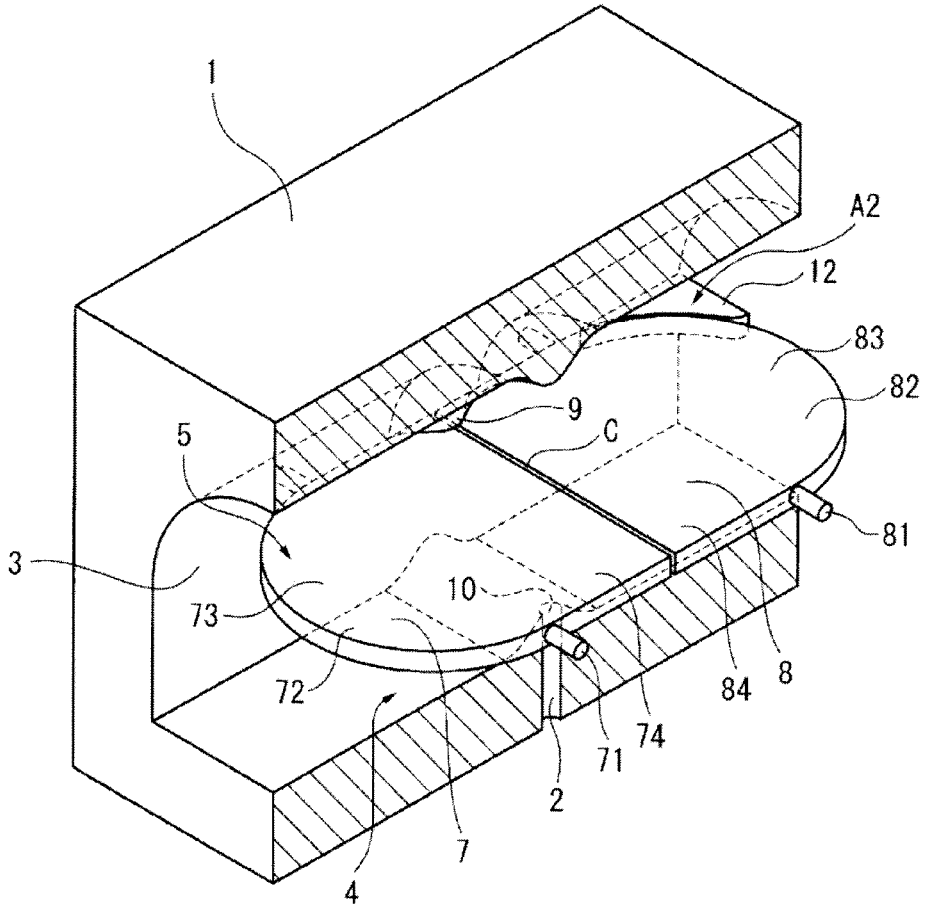
FIG. 12 is a cross-sectional view illustrating the carburetor according to the fifth embodiment of the present invention.
Figure 13A:
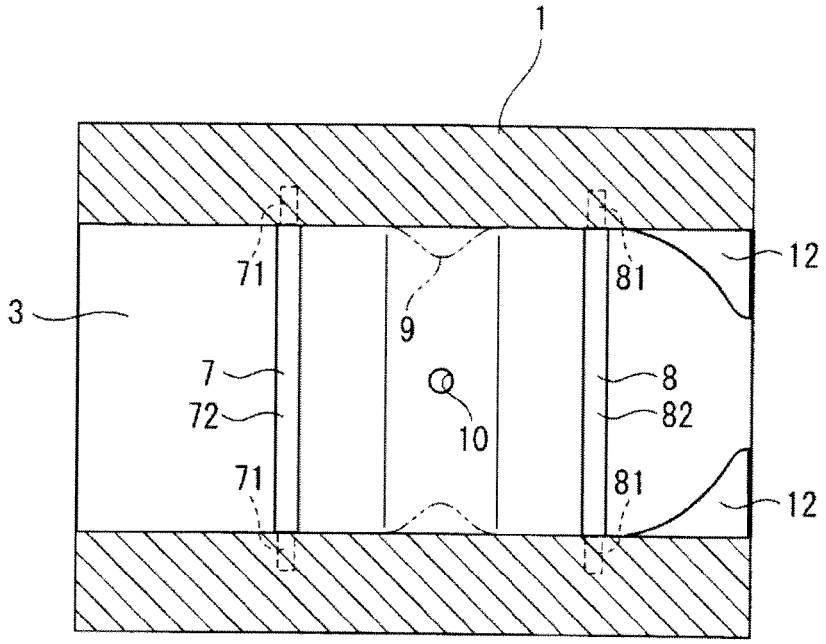
FIG. 13A is a cross-sectional view of the carburetor according to the fifth embodiment, illustrating the fully closed state.
Figure 13B:
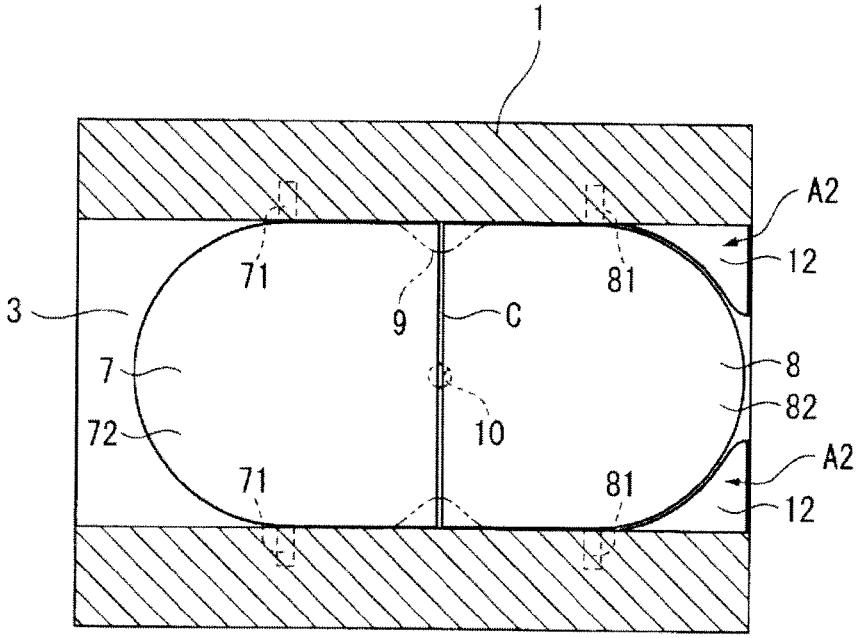
FIG. 13B is a cross-sectional view of the carburetor according to the fifth embodiment, illustrating the fully opened state.

FIG. 11 shows the carburetor 1 according to the fourth embodiment of the present invention. In the second embodiment described above, the cross-sectional geometry of the venturi 9, which is also the bulging portion 11, is uniform in the circumferential direction and the venturi 9 has a relatively small opening area, whereas in this embodiment, the bulging portion 11 according to this embodiment is formed by increasing the bulging amount continuously only for the part accommodating region A1 and the venturi 9 is formed to be of the same size as traditional ones (same as the third embodiment) for other parts.

In other words, the bulging portion 11 according to this embodiment is constructed from the bulging portion 11 in the third embodiment with a gently curved surface continuous toward the venturi 9. In this case, although the cross-sectional geometry of the venturi 9 is not uniform in the circumferential direction and the opening shape is not a circle, the opening area does not need to be made as small as the second embodiment while blocking region A1 well, and it can be constructed in the same way as a regular carburetor.

Fifth Embodiment

Figure 9:
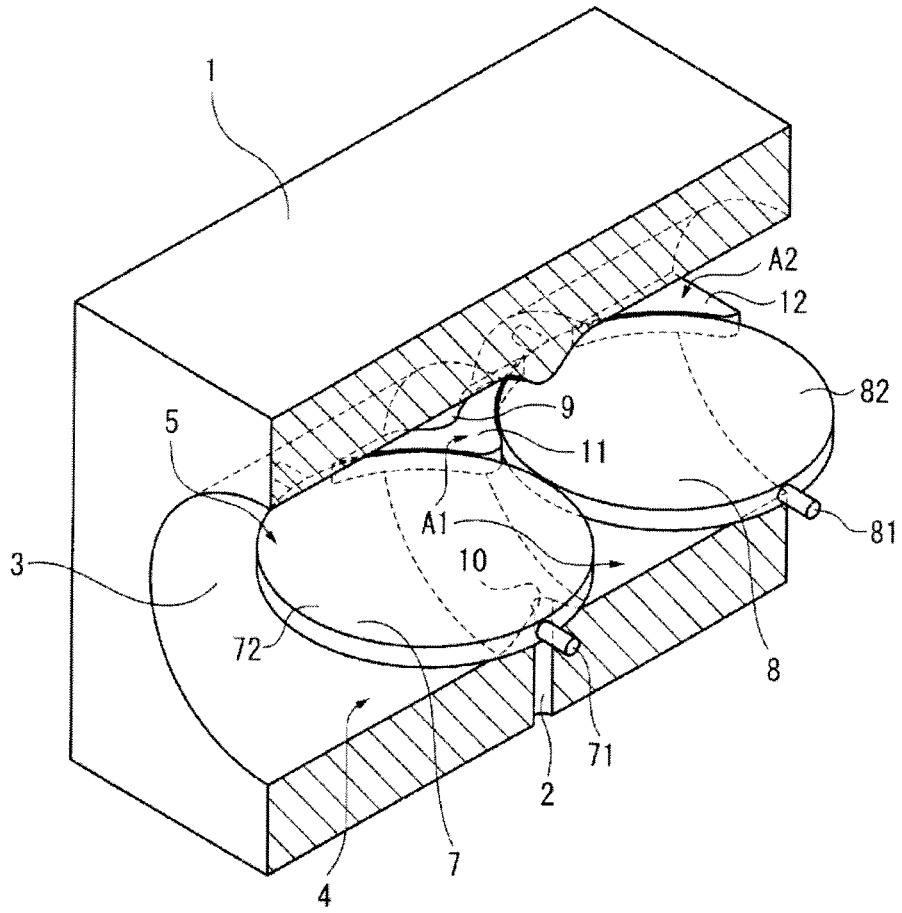
FIG. 9 is a cross-sectional perspective view illustrating the carburetor according to the third embodiment.

FIGS. 9-10 show the carburetor 1 according to the fifth embodiment of the present invention. In this embodiment, the cross-sectional geometry of the air intake channel 3 is half a long hole shape with the side of the flat surface having the main jet 10, whereby the geometry of the rotating plates 72 and 78 of valves 7 and 8 is also a half long hole shape. In other words, the rotating plates 72 and 82 are provided with arc sections 73 and 83 having their edges in an arc shape and block sections 74 and 84 having their edges as a straight line. These valves 7 and 8 are rotatably operated so that the block sections 74 and 84 are closely opposed in their fully opened state.

Also, when the valves 7 and 8 are in their fully opened state, gap C with straight lines between the closely opposed rotating plates 72 and 82 is provided nearly uniformly widthwise (the rotating shaft direction of the valve 7 and 8) of the air intake channel 3. Therefore, when the valves 7 and 8 are in their fully opened state, the air intake channel 3 is again divided into the air-fuel mixture channel 4 at the main jet 10 side and the air channel 5 for guiding air containing no fuel by said valves 7 and 8. Further, since the width of gap C (the width in the air intake flow direction) is small, no air/fuel mixture is mixed into the guiding air through gap C and the channels 4 and 5 are divided more securely.

Moreover, in this embodiment, the venturi 9 is cut so as not to prevent the rotation of the valves 7 and 8, resulting in uncontinuous geometry in the middle of the circumferential direction inside the air intake channel 3. In the venturi 9 as such, both ends of the part formed within the air channel 5 are a flat surface and its rotation amount is regulated by the block sections 74 and 84 of the rotating plates 72 and 82 abut.

According to the embodiments above, the air intake channel 3 can be divided into the air-fuel mixture channel 4 and the air channel 5 only by the valves 7 and 8, and since there is no traditional members such as a divider plate or partition wall between the valves 7 and 8, the valves 7 and 8 can be arranged closely until they are nearly in contact across the small gap C, resulting in an effect in which the length of the carburetor 1 can be reduced without fail. In addition, it is not required to provide a flow guide element, etc. for each of the valves 7 and 8, allowing simpler construction.

It should be noted that the present invention is not limited to each embodiment described above, and various modifications are included in the present invention within the scope as long as they achieve the objective of the present invention.

For example, although the cross-sectional geometry of the air intake channel 3 is a half long hole shape while the geometry of the rotating plates 72 and 82 are a half long circle shape according to the fifth embodiment above, even if their geometries are rectangular, they are to be included in the present invention.

FIELD OF INDUSTRIAL APPLICATION

The carburetor according to the present invention can be employed in a two-stroke engine in a portable operating machine such as a chainsaw, a lawn mower, and an engine blower.

Explanation of the Symbols

1. Carburetor; 3. Air Intake Channel; 4. Air-fuel mixture Channel; 5. Air Channel; 7. Choke Valve; 8. Throttle Valve; 9. Venturi; 10. Main Jet as a fuel port; 11. Bulging Portion; A1. Region; and C. Gap

The invention claimed is:

1. A carburetor comprising:

an air intake channel;

a venturi disposed in the air intake channel, the venturi including an inwardly extending bulging portion;

a choke valve disposed in the air intake channel on the upstream side of the venturi;

a throttle valve disposed in the air intake channel on the downstream side of the venturi, wherein:

the choke valve and the throttle valve are each rotatable between a fully closed position in which the choke valve and the throttle valve are substantially parallel and a fully opened position in which an edge of the choke valve and an edge of the throttle valve are closely opposing each other, thereby forming a nearly triangular region in a planar view between the edge of the choke valve and the edge of the throttle valve on the inner periphery of the air intake channel;

the bulging portion extends into the nearly triangular region defined between the closely opposing edge of the choke valve and the edge of the throttle valve;

the air intake channel is divided into an air-fuel mixture channel at which a fuel intake port is provided and an air channel through which guiding air flows by the choke valve and the throttle valve when in the fully opened position and the bulging portion;

the bulging portion of the venturi occupies a substantial part of the nearly triangular region between the edge of the choke valve and the edge of the throttle valve when they are in their fully opened positions, thereby preventing fuel from entering the air channel from the air-fuel mixture channel; and a plate-shaped bulging portion fills a void defined by the edge of the throttle valve in the fully opened position and an exit of the carburetor.

2. The carburetor of claim 1, wherein the bulging portion of the venturi does not extend into an upper half of the air intake channel.

3. The carburetor of claim 1, wherein the bulging portion forms a vertical inner portion of the venturi.

4. The carburetor of claim 1, wherein the edge of the choke valve in the fully opened position and the edge of the throttle valve in the fully opened position are almost in contact.

5. The carburetor of claim 4, wherein the edge of the choke valve and the edge of the throttle valve are radiused to provide relief from interference as the choke valve and the throttle valve rotate into and out of the fully opened position.

6. The carburetor of claim 1, wherein the choke valve and the throttle valve lie in the same plane when in the fully opened position.

7. The carburetor of claim 1, wherein a cross-sectional area of the venturi is narrowest at a longitudinal location corresponding with a midpoint between the closely opposing edge of the throttle valve and the edge of the choke valve.

* * * * *